United States Patent [19]

Frantzen

[11] 4,221,084

[45] Sep. 9, 1980

[54] ABRASIVE TOOL

[75] Inventor: John J. Frantzen, White Bear Lake, Minn.

[73] Assignee: Minnesota Micro Metal, Inc., St. Paul, Minn.

[21] Appl. No.: 943,114

[22] Filed: Sep. 18, 1978

[51] Int. Cl.[3] ..... B24D 15/02

[52] U.S. Cl. ..... 51/392; 51/181 R

[58] Field of Search ..... 51/181 R, 358, 367, 51/382, 383, 391, 392, 393

[56] References Cited

U.S. PATENT DOCUMENTS

| | | | |
|---|---|---|---|
| 1,181,123 | 5/1916 | Edenborough | 51/392 X |
| 1,599,906 | 9/1926 | McKnight | 51/392 X |
| 2,459,893 | 1/1949 | Peterson | 51/392 X |
| 2,626,489 | 1/1953 | Thompson | 51/391 X |
| 2,756,549 | 7/1956 | Macullar | 51/391 |
| 2,904,939 | 9/1959 | Raia | 51/392 X |
| 2,922,177 | 1/1960 | Hudson | 51/382 X |
| 3,410,035 | 11/1968 | Gohde | 51/391 |
| 3,864,884 | 2/1975 | Weissman | 51/358 |

*Primary Examiner*—Gary L. Smith
*Assistant Examiner*—Robert P. Olszewski
*Attorney, Agent, or Firm*—Neil B. Schulte

[57] ABSTRACT

An abrasive tool having a base portion with etched metal abrasive thereon and a handle portion adapted to snap onto the base in two alternate positions, one position being tight for using the etched metal abrasive and the other position being raised slightly to accomodate, between the handle and the base, a piece of sandpaper wrapped around the base.

1 Claim, 9 Drawing Figures

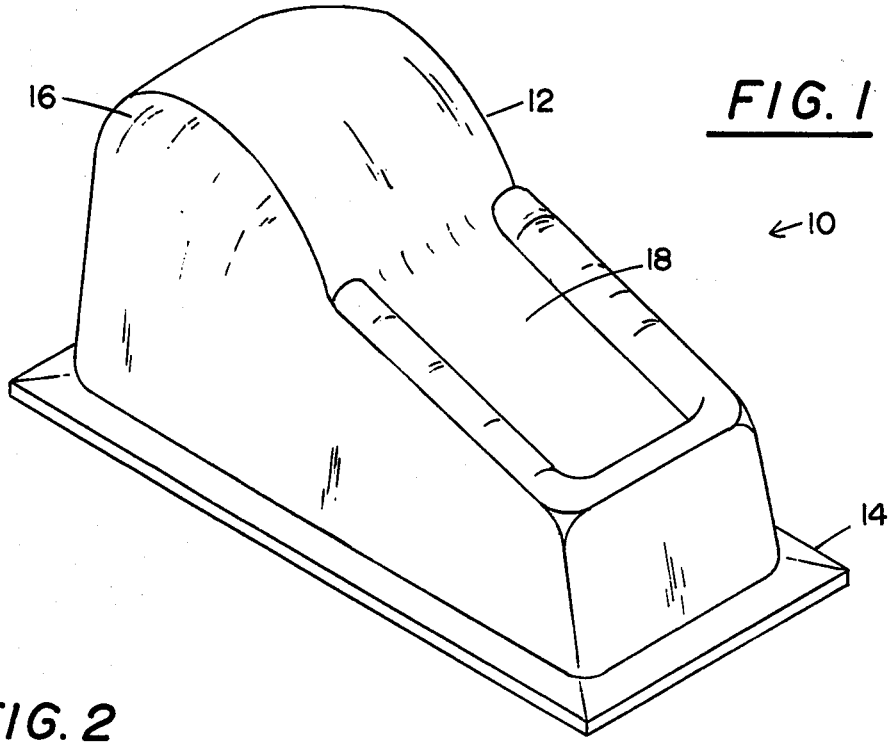
FIG. 1
FIG. 2
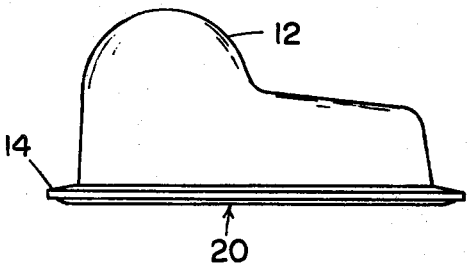
FIG. 3
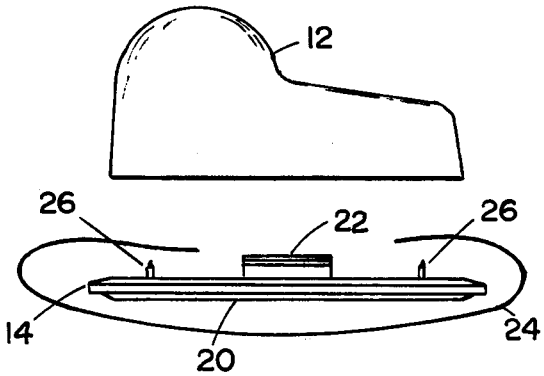
FIG. 8
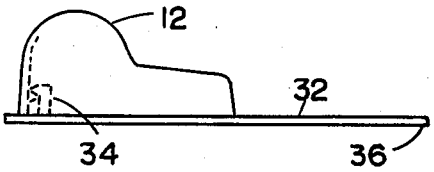
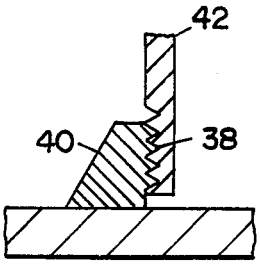
FIG. 9

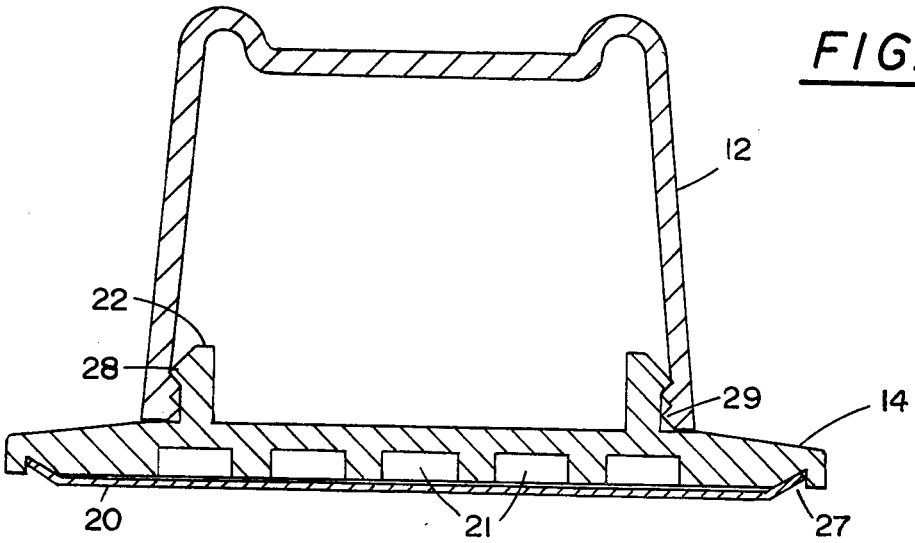
FIG. 4
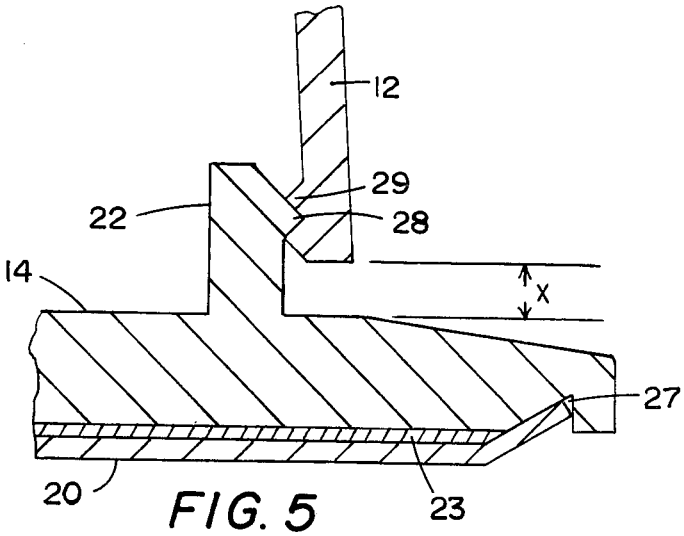
FIG. 5
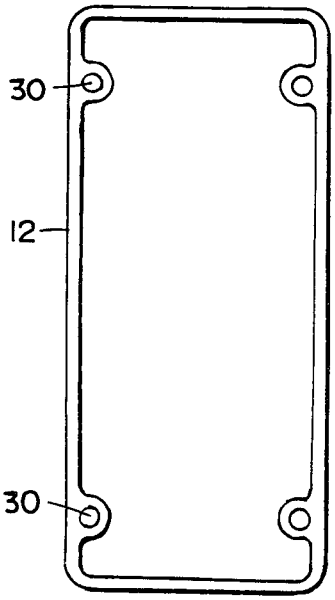
FIG. 7
FIG. 6
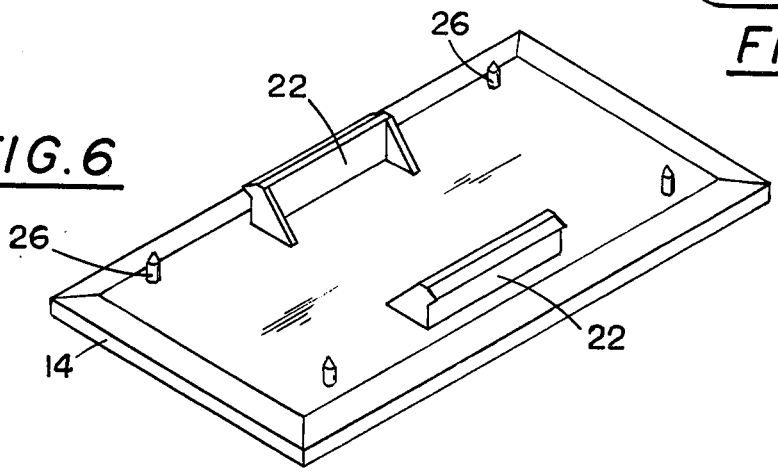

ABRASIVE TOOL

BACKGROUND OF THE INVENTION

Abrasive tools of the type commonly referred to as sanding blocks are known in the prior art in two basic configurations. One type uses an etched metal abrasive bonded to the bottom surface which is quite durable and long lasting. The other type of sanding block utilizes a base which is wrapped with sandpaper. The sandpaper is less durable but can be changed frequently allowing flexibility as to the fineness or coarseness of the sanding. It would be desirable to have the flexibility to use either an etched metal abrasive or sandpaper but this has not been possible in the prior art. The edges of the metal abrasive surface are usually so sharp that they would cut through a piece of sandpaper on the block. In the alternative, a block designed to accept a piece of sandpaper will have a loose fitting handle when the sandpaper is not in position and thus be difficult and clumsy to use. My invention overcomes these problems with the design of a new and special sanding block designed to accomodate both etched metal abrasive and, if desired, sandpaper at the same time.

SUMMARY OF THE INVENTION

Briefly, the present invention comtemplates a molded plastic sanding block in which etched metal abrasive is bonded to the pressure face but recessed into a perimeter groove so that the edges of the etched metal abrasive can not cut a piece of sandpaper wrapped around the sanding block. In addition, the sanding block incorporates a removable handle with a special alternate position catch mechanism so that the handle can be fastened tightly to the block while using the etched metal abrasive but separated slightly to permit the insertion of a piece of sandpaper between the handle and the block if that type of operation is desired. Thus, it may be seen that it is an object of my invention to provide an improved abrasive tool which permits the operator to utilize either sandpaper or an etched metal abrasive. Additional objects and advantages will become apparent upon consideration of the following detailed description and drawings.

BRIEF DESCRIPTION OF THE DRAWINGS

FIGS. 1 and 2 show respectively a perspective and a side elevational view of the abrasive tool of the present invention.

FIG. 3 shows the handle of the abrasive tool separated from the base portion to permit the insertion of a piece of sandpaper.

FIG. 4 is a sectional view through the center of the abrasive tool to show the internal construction thereof.

FIG. 5 is an enlarged fragmentary view of one portion of the tool showing the two position catch.

FIG. 6 is a perspective view of the top of the base of the tool showing the position and shape of the catches thereon.

FIG. 7 is a bottom view of the handle portion of the tool showing the holes therein.

FIGS. 8 and 9 show other embodiments of the invention.

DESCRIPTION OF THE PREFERRED EMBODIMENT

In FIG. 1 the abrasive tool of the present invention is shown. The tool comprises basically a handle portion 12 and a base portion 14. Handle 12 is rounded as at 16, to provide a comfortable gripping surface and includes a recessed portion 18 into which one or more fingers can be inserted to help push the tool along a surface to be abraded.

In FIG. 2 it may be seen that the lower or pressure surface of base 14 includes an etched metal abrasive material 20 bonded thereon with a layer of glue 23 which may be more clearly seen in FIG. 5. In FIG. 5 it can be seen that the edges of the etched metal abrasive 20 are recessed into a perimeter groove 27. Perimeter groove 27 extends about the whole circumference of the pressure face of base 14. Thus, the edges of the etched metal abrasive 20 do not extend out to the edge of the tool where they might cut a piece of sandpaper wrapped around the base 14. As seen in FIG. 4, the preferred embodiment molds the base 14 with several voids which the etched metal abrasive 20 spans across. These voids are for the convenience of the molding process only and may or may not be included.

Returning to FIG. 3 it may be seen that handle 12 can be removed from base 14 by disengaging it from a pair of catches 22. A piece of sandpaper 24 can then be wrapped around base 14, as shown in FIG. 3, and trapped between the handle 12 and base 14. A number of small pointed pins 26 extending up from base 14 help secure the sandpaper 24. Catches 22 may be more clearly seen with respect to FIGS. 4 and 5.

Two catches 22 are molded onto base 14 each having a protuberance 28. Catches 22 are springable as is the handle 12 which is molded with a pair of protuberances 29 thereon. The handle 12 can be snapped over catches 22 so that both of the protuberances 29 are below protuberance 28 as in FIG. 4. In this way handle 12 is mounted tightly to base 14 and the tool can be used with the etched metal abrasive 20 alone. For use with sandpaper however, handle 12 can be snapped over protuberance 28 on springable catch 22 as shown in FIG. 5 with the handle separated from the base by a small distance X which is sufficient to accomodate sandpaper 24 between the handle and the base portion. Accordingly, the handle will fit tightly to the base with or without a piece of sandpaper in position.

In the perspective view of FIG. 6 it may be seen that catches 22 are elongated in order to hold handle 12 tightly to the base portion 14 at both ends so that sandpaper 24 will be tightly retained about the base. The position of pins 26 is more apparent from the view of FIG. 6. These pins 26 puncture sandpaper 24 and enter holes 30 in the bottom of handle 12. Holes 30 are more clearly seen in FIG. 7 which comprises a bottom view of handle 12.

Since handle 12 is removable, different shapes of bases may be interchangeably used with the handle. An elongated base 32 is shown in FIG. 8. This type of base provides a longer abrasive surface but may require an additional springable catch 34 to grasp the inside rear portion of the handle and resist abrasive pressures at the tip 36 of base 32.

In order to accomodate different thicknesses of sandpaper, additional protuberances 38 may be formed on the springable catch 40 and the handle 42 as shown in FIG. 9. With this embodiment several alternative positions are possible with a plurality of different spacings between the handle and the base.

I claim:

1. An abrading tool adapted to hold etched metal abrasive material and also sandpaper, as desired, comprising in combination:

a base portion having a top surface and a generally flat bottom pressure face with a recessed groove on the bottom face about the perimeter thereof;

metal abrasive material affixed to said pressure face with the edges of the metal abrasive material bent into said perimeter groove;

at least two springable catch members extending generally perpendicular from said base portion, from the top surface opposite said pressure face, said catches having protuberances thereon which protuberances extend outwardly toward the nearest edge of said base portion;

a handle portion adapted on the outside surface for convenient gripping and having an inside surface with at least two alternate position protuberances thereon which extend inwardly to engage the base mounted springable catch protuberances in first and second alternate positions, the first position being generally with the handle close to the base for using the metal abrasive and the second position being with the handle separated from the base by a distance adequate to trap a piece of sandpaper between the base and the handle when sandpaper is wrapped about the base portion, said handle having a hump at one end to engage the palm of the users hand and a recess at the other end to accept the users fingers, said handle also having outside dimensions smaller than the base portion so that a portion of the base portion extends outward beyond the handle to form a protective ledge for the users fingers;

said tool further including a plurality of generally pointed pins extending from said top surface so as to penetrate and secure said sandpaper wrapped about said base and further including holes in said handle positioned to receive said pins when the handle is affixed to the base.

* * * * *